United States Patent [19]

Bayba

[11] Patent Number: 4,825,167

[45] Date of Patent: Apr. 25, 1989

[54] SPARK PLUG TESTING UNDER DYNAMIC LOAD

[75] Inventor: Richard Bayba, Sun Lakes, Ariz.

[73] Assignee: General Motors Corporation, Detroit, Mich.

[21] Appl. No.: 115,111

[22] Filed: Nov. 2, 1987

[51] Int. Cl.[4] ..... F02P 17/00

[52] U.S. Cl. ..... 324/399; 324/393; 324/402; 73/116

[58] Field of Search ..... 324/384, 385, 391, 392, 324/393, 394, 399, 402; 73/116, 117.2

[56] References Cited

U.S. PATENT DOCUMENTS

| | | | |
|---|---|---|---|
| 4,006,403 | 2/1977 | Olsen et al. | 324/399 X |
| 4,053,823 | 10/1977 | Adamian | 324/399 X |
| 4,684,896 | 8/1987 | Weishaupt | 324/399 |

*Primary Examiner*—Reinhard J. Eisenzopf
*Assistant Examiner*—Jack B. Harvey
*Attorney, Agent, or Firm*—Reising, Ethington, Barnard, Perry & Milton

[57] ABSTRACT

A method of testing spark plugs in an engine is described. The engine is driven by its starter motor or other motor while ignition voltage is applied, the throttle is open and the fuel is cut off. This loads the spark plugs to reveal defects not otherwise apparent. Abnormally high or low plug peak voltages as well as abnormal arc durations are detected and counted and the counts are displayed. A microprocessor based measuring instrument coupled to capacitive pickups adjacent the spark plug wires and to the engine distributor evaluates the spark voltage and duration characteristics and displays the fault data.

11 Claims, 2 Drawing Sheets

SPARK PLUG TESTING UNDER DYNAMIC LOAD

FIELD OF THE INVENTION

This invention relates to testing spark plugs and particularly to such testing under engine motoring conditions.

BACKGROUND OF THE INVENTION

It is desirable to test spark plugs for automotive engines as a quality control measure in spark plug manufacturing, to assure engine quality at the time of engine manufacture, and to diagnose engine problems on vehicles already in service. In each case it is helpful to run the test in a manner which resembles actual operating conditions without introducing unknown or difficult-to-control variables.

In making a spark plug load test, the object is to detect any physical problems in the spark plug. It has long been recognized that spark plug tests must be run under load in order to reveal defects which cause problems under actual running conditions. Spark plug load refers to the electrical load or impedance that the spark plug presents to the high voltage ignition circuit.

Spark plug performance is controlled by two basic conditions. One is the physical (electrical) condition of the spark plug gap. The second is the physical condition within the spark plug gap itself at the precise instant that the ignition voltage is applied. These conditions are as follows:

Physical Condition of the Spark Plug Gap.

1. Size of the gap.
2. Condition of the electrodes: geometry and contamination.
3. Resistance of the insulation.
4. Cracks or deformities in the insulation.
5. Open electrode path.

Physical Conditions within the Spark Plug Gap.

1. Gas pressure at the instant of ignition. This pressure is dependent upon ignition timing, engine load, compression ratio and engine RPM.
2. The gas velocity passing through the spark plug gap at the instant of ignition.
3. Engine fuel. The actual composition of the fuel being fed into the gap.
4. The temperature of the gas.
5. The fuel/ratio at the instant of ignition.

In prior spark plug load testing it has been the practice to make measurements under actual engine running conditions with a constant engine load imposed by a dynamometer. To make the spark plug test as repeatable and therefore as valid as possible, it was necessary to control the condition of the fuel as much as possible. While it was possible to maintain a consistent fuel quality (in the manufacturing environment) the fuel/air mix and its velocity in the plug gap at the instant of applied ignition voltage always remained a problem. Because of those two variables, the spark plug load readings displayed a somewhat erratic pattern from reading to reading. To compensate for this lack of control, several sets of spark plug load readings were taken and then average prior to being displayed by the measuring instrument.

Some other variable conditions can be controlled during testing. These are engine speed, timing and torque. By keeping these three conditions as constant as possible and by using an averaged spark plug load, an acceptable level of test result validity can be achieved. Still, this test has limited application since the expense of a dynamometer precludes its use in many places where spark plug testing is desired in the manufacturing process.

Moreover, the prior test is wholly impractical for vehicle servicing at local garages.

SUMMARY OF THE INVENTION

It is therefore an object of the invention to provide a method of testing spark plugs in an engine under dynamic load and requiring no dynamometer or other very expensive equipment.

It is another object of the invention to provide such a method which has few sensitive control variables and which produces accurate results.

It is another object of the invention to provide a method of testing spark plug load in engines installed on vehicles.

The invention is carried out by a method of testing spark plugs under load while installed in an engine comprising the steps of; opening the throttle of the engine to wide open position, applying ignition voltage to the spark plugs, driving the engine by an external power source without applying fuel to the engine, sensing the voltage and/or spark duration developed in the spark plugs, and evaluating the voltage level and/or arc duration of each spark plug and comparing it to acceptable standards.

BRIEF DESCRIPTION OF THE DRAWINGS

The above and other advantages of the invention will become more apparent from the following description taken in conjunction with the accompanying drawings wherein like reference numerals refer to like parts and wherein.

DESCRIPTION OF THE PREFERRED EMBODIMENT

Motoring an engine to test spark plugs provides an easily implemented spark plug stress technique as an alternative to an engine running under its own power and operating under load. Such a simulation facilitates spark plug load tests without the use of an engine load absorption device in hot test stands as well as in a vehicle.

Figure 1:
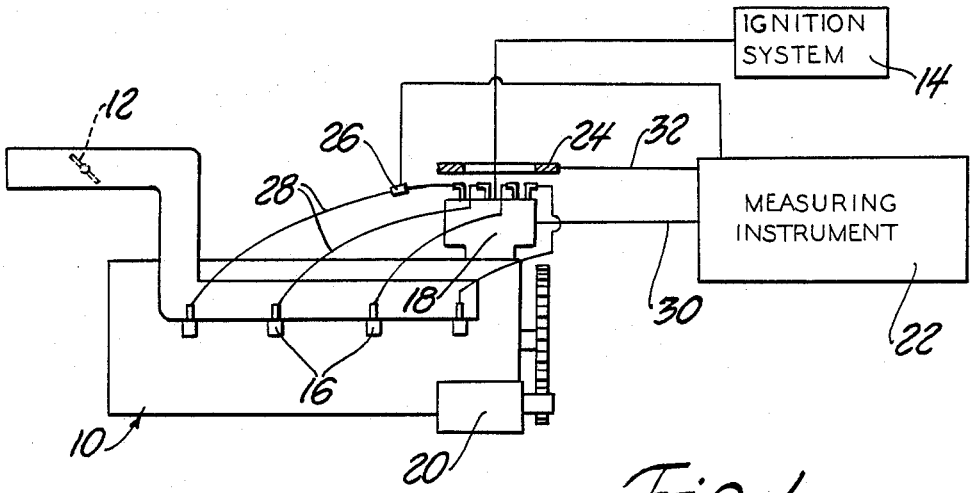
FIG. 1 is a schematic view of testing equipment attached to an engine for performing the method according to the invention.

As shown in FIG. 1, an engine 10 has standard equipment including a throttle 12 in the induction passage, an ignition system 14 which includes spark plugs 16 and a distributor 18, and a starter 20. The fuel system is not shown.

Instrumentation for carrying out the method of the invention is not new, per se, since the basic components have been used with the prior art method. The special test equipment requires an instrument 22 for analyzing the spark voltage signals and giving an output indication of defective operation. The preferred instrument for this purpose is a Motorola 6800 microprocessor based measuring and control device commerically available from Balance Engineering Corp., Troy, Mich., as CBI-55. The unit is equipped with an input board with circuits to sample and hold the peak voltage of each spark pulse and to perform an analog-to-digital conversion for inputting to the digital circuits of the CBI unit.

Several inputs are coupled to the CBI unit 22. A capacitive pickup 24 for sensing the spark plug voltage comprises a metal ring or a plastic ring with an embedded conductor which fits atop the distributor 26 adjacent the spark plug wires 28. The pickup 24 develops a signal corresponding in magnitude to each spark voltage pulse. A second pickup 26 is attached to the number one spark plug wire to obtain a signal indicating when that spark plug fires to allow the subsequent spark signals to be correlated to specific spark plugs. A tachometer signal produced by the distributor 18 is coupled to the CBI unit via conductor 30. The tachometer signal contains information defining the duration of each spark pulse.

Figure 2:
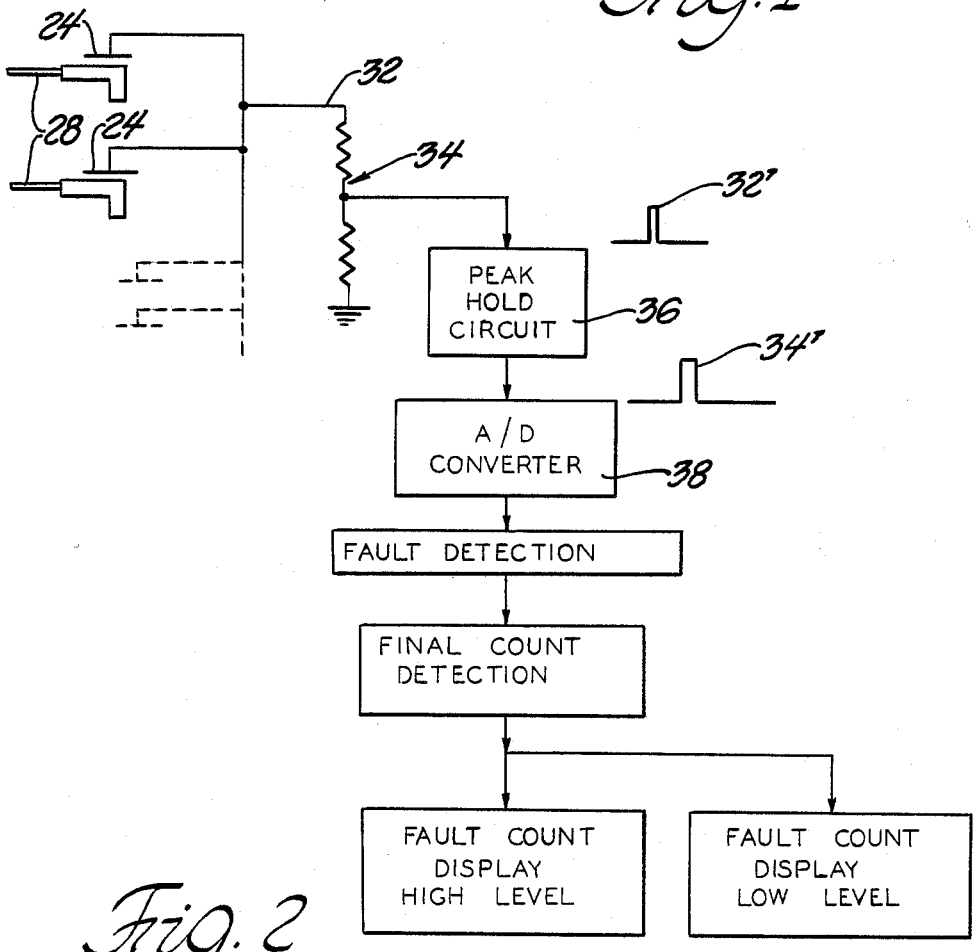
FIGS. 2 and 3 are schematic circuit drawings of apparatus for measuring and evaluating spark voltage and duration, respectively for practicing the method of the invention.

FIG. 2 depicts the CBI circuit for processing the signal from the pickup 24. The capacitive pickup 24 adjacent the boot of each spark plug wire 28 is shown schematically as a separate pickup for each wire. A single conductor 32 leads to a voltage divider or scaling circuit 34 which is coupled to a peak hold circuit 36 on the input board to change the momentary high voltage pulse 32' to a wider signal 34' of the same amplitude. An A/D converter 38 supplies an equivalent value to the microprocessor circuit which detects the faults, counts the faults and normalizes the the count value, and alternately displays the normalized high and low fault count values.

Figure 3:
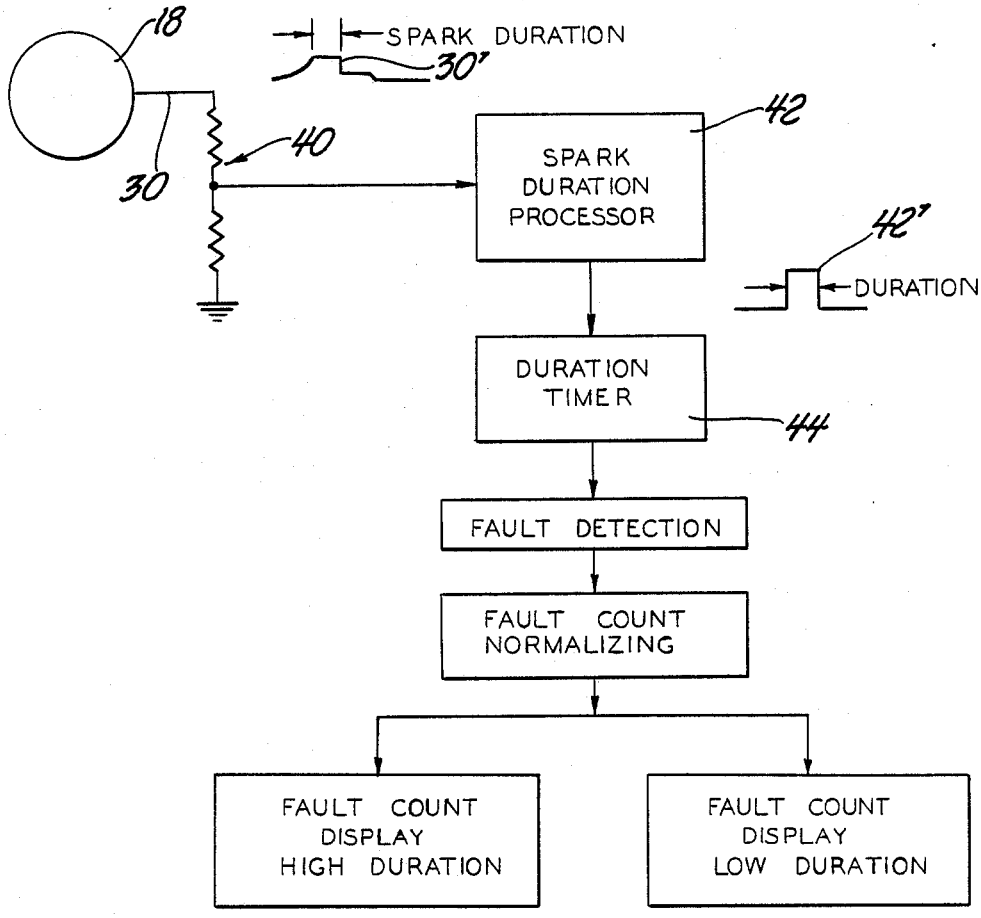

FIG. 3 depicts the spark duration processing circuit. The line 30 carries the tachometer signal from the distributor 18 to the input board of the CBI 22. That board provides a scaling circuit 40 and a spark duration processor 42 incorporating a flip-flop which responds to the tachometer signal 30' to produce a square wave pulse 42' having a width equal to the pulse duration. A programmable timer 44 digitizes the pulse width and furnishes that digital signal to the digital circuitry of the CBI unit 22 which detects duration faults, counts the faults and normalizes the count value, and alternately displays the normalized high and low fault values.

Figure 4:
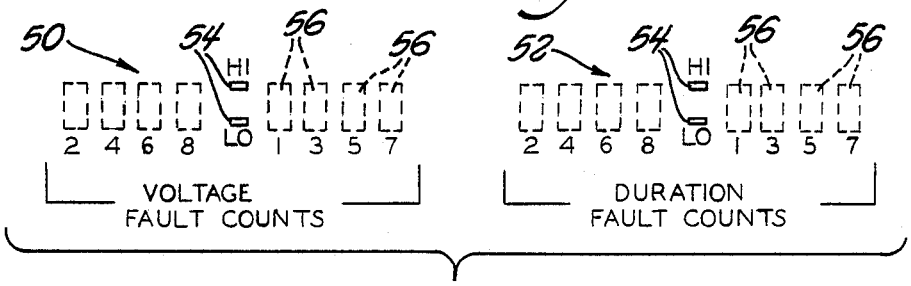
FIG. 4 is a view of a display for the apparatus of FIGS. 2 and 3 for indicating measured faults in spark voltage and duration.

As shown in FIG. 4, the display of the CBI unit 22 separately displays the peak voltage faults and the duration faults. Left and right groups of indicators 50 and 52 give voltage fault and duration fault information respectively. Each group of the display has a single digit numeric indicator 56 for each cylinder and is divided into two banks. The right bank displays (for a V-8 engine) cylinders 1, 3, 5 and 7 while the left bank displays the remainder. In each group a central pair of LED's 54 indicate whether high or low indications are currently on display.

The CBI unit is programmed to continually switch between the high and low impedance readings. The high peak voltage fault count and the short duration fault count are shown simultaneously and after a few seconds, say about four seconds, the display changes to show the low peak voltage fault count and the long duration fault count. In this way the high and low impedance gaps are segregated and the correlating high or low count rates are displayed simultaneously.

In operation, the engine is motored or driven externally in its normal rotation direction. The driving source can be any device such as a dynamometer, test stand starter or the engine starter. When the engine starter is used, the rotation speed is usually about 200 RPM. This is an excellent speed for the test since it yields the correct range of spark plug loading when the test is set up according to the following description.

The air intake throttle valve is placed in its full open position. This position is preferred because it can be easily repeated as a test condition. The engine fuel is turned off and the ignition system is turned on. The ignition power supply or battery should be held at the normal 12 volt level. When the engine is motored under these conditions the cylinder air pressure can be very high and the spark gap impedance will be correspondingly high and sufficient to test the spark plug. That is, the spark plug gap breakdown or ionization voltage will be high at high pressures thus allowing the spark plug voltage to become sufficiently high to reveal spark plug defects. If, on the other hand, the voltage becomes too high, then arcing externally of the engine such as between the spark plug wires and the engine block, can occur. This has been observed at high engine speeds when high cylinder pressures were obtained and the ignition voltage was applied near the peak of the pressure. This condition should be avoided by running the engine at a slower speed or selecting ignition timing so that the spark plugs will fire when the spark plug impedance is low enough to avoid the external arcing. The test conditions (throttle setting, RPM and timing) should be repeatable since they affect the peak spark plug ionization voltage and the spark plug arc duration time. These are the two parameters which are monitored.

Motoring under the above described conditions simulates a loaded engine running under its own power in that the spark plug impedance is raised to a similar or higher value than the spark plug impedance of a loaded engine. Comparison tests have shown that a given engine when run with fuel at 800 RPM with a load of 150 ft.lbs. applied by a dynamometer yielded an ignition voltage level of 18 KV. The same engine motored in accordance with the method of the invention at 220 RPM yielded an ignition voltage level of 20 KV. Such testing will produce greater repeatability of spark plug arc conditions than an engine run under load. One reason for this is that the low RPM operation will produce lower air or gas swirl through the spark plug gap.

The CBI unit 22 receives the spark plug voltage signals and the tachometer signal and makes a comparison with preset peak voltage and arc duration values or value ranges. For a given air pressure in the gap, the ionization voltage of a good spark plug will fall within a range and any events above or below that range are counted and displayed. Generally, a spark plug which exhibits a high peak voltage has a high impedance and will thus impose a short time constant on the ignition circuit. The arc duration for such a spark plug will be relatively short. Similarly, a low peak voltage usually corresponds to a long arc duration. The CBI unit 22 calculates the duration from the tachometer signal on line 30, compares that to a preset range, and indicates events above or below that range as faults. While the display of both duration and voltage faults may seem to be redundant, practical experience has shown that in some cases one will reveal a defective spark plug better than the other. There is another advantage not related to spark plug condition but which is important to the test. If the test setup has been properly calibrated, a high number of high voltage faults will be accompanied by a high number of short duration faults. If that correlation does not occur, the system should be recalibrated. Another possible cause of poor correlation is a result of defective spark plug wires or bad spark plug wire connections. Thus, in a sense, the system is self-diagnostic since the displayed indications reveal the problems which might cause misleading spark plug defect indications.

Calibration of the test system requires operating the test at a desired engine RPM and timing angle with known good spark plugs and adjusting the acceptable ranges on the CBI unit to the smallest ranges which yield no defect indications.

The method of counting faults is as follows:

1. The voltage of an individual spark is measured.

2. The measured voltage is compared with the preset acceptable voltage range.

3. The CBI unit internally records the measurement as an acceptable, high or low reading. High and low readings are labeled as faults.

4. The CBI unit accumulates the fault counts occurring in a selected set of consecutive voltage measurements for each spark plug and displays the results on a scale of 0 to 9. Depending upon engine RPM and display time, a convenient set to avoid missing and faults would be 9 measurements for a speed up to 260 RPM, 18 measurements for a range of 260 RPM to 520 RPM, or 36 measurements for a range of 520 RPM to 1040 RPM. For the purpose of normalizing the results for display on the same scale, the fault counts for sets of 18 and 36 are divided by 2 and 4, respectively.

5. If all measurements are acceptable the CBI unit will display a fault count of zero. If any faults exist, the total or normalized number of each type of fault (high or low) is then displayed as the high or low fault count for the respective cylinder.

The engine must be motored a few seconds to acquire the required number of counts. The method of the invention provides such good repeatability, however, that the test period can be reduced to accumulate only a set of 9 or at most 18 measurements, thus dispensing with any long term averaging and minimizing the motoring time.

It will thus be seen that the method of the invention greatly facilitates engine testing of spark plugs with a speed, simplicity and accuracy not previously achieved, yet requiring no expensive loading device. This facilitates accurate, inexpensive spark plug testing in manufacturing facilities as well as in vehicle service garages.

The embodiments of the invention in which an exclusive property or privilege is claimed are defined as follows:

1. A method of testing spark plugs under load while installed in an engine comprising the steps of;

opening the throttle of the engine to wide open position, applying ignition voltage to the spark plugs, driving the engine by an external power source without applying fuel to the engine, sensing the voltage characteristics developed in the spark plugs, and evaluating the voltage characteristics of each spark plug and comparing it to acceptable standards.

2. A method of testing spark plugs under load while installed in an engine comprising the steps of;

opening the throttle of the engine to wide open position, applying ignition voltage to the spark plugs, driving the engine by an external power source without applying fuel to the engine, sensing the voltage developed in the spark plugs, and evaluating the voltage level of each spark plug and comparing it to acceptable standards.

3. A method of testing spark plugs under load while installed in an engine comprising the steps of;

opening the throttle of the engine to wide open position, applying ignition voltage to the spark plugs, driving the engine by an external power source without applying fuel to the engine, sensing the peak voltage and the arc duration developed in the spark plugs, and evaluating the voltage level and arc duration for each spark plug and comparing them to acceptable standards.

4. A method of testing spark plugs under load while installed in an engine comprising the steps of;

opening the throttle of the engine to wide open position, applying ignition voltage to the spark plugs, driving the engine by an external power source without applying fuel to the engine, sensing the voltage developed in the spark plugs, comparing the voltage level of each spark plug to a preset voltage range and signalling a fault condition when a spark plug voltage level is outside the range, and displaying the frequency of fault conditions.

5. A method of testing spark plugs under load while installed in an engine comprising the steps of;

opening the throttle of the engine to wide open position, applying ignition voltage to the spark plugs, driving the engine by an external power source without applying fuel to the engine, sensing the voltage developed in the spark plugs, measuring the arc duration developed in each spark plug, comparing the voltage level of each spark plug to a preset voltage range and signalling a voltage fault condition when a spark plug voltage level is outside the range, and comparing the arc duration in each spark plug to a preset duration range and signalling a duration fault condition when a spark plug arc duration is outside the range, and simultaneously displaying the frequency of voltage and duration fault conditions.

6. A method of testing spark plugs under load while installed in an engine in a vehicle comprising the steps of;

opening the throttle of the engine to wide open position, shutting off the fuel supply to the engine, applying ignition voltage to the spark plugs, motoring the engine by operating the starting motor, capacitively sensing the voltage developed in the spark plug wires, and evaluating the voltage level developed in each spark plug wire and comparing it to predefined voltage levels.

7. A method of testing spark plugs under load while installed in an engine in a test stand, comprising the steps of;

opening the throttle of the engine to wide open position, applying ignition voltage to the spark plugs,
driving the engine by an external power source without applying either load or fuel to the engine,
sensing the voltage developed in the spark plugs,
evaluating the voltage level of each spark plug and comparing it to acceptable standards to detect faults,
counting the faults over a predetermined test period, and
displaying the fault count.

8. A method of testing spark plugs under load while installed in an engine comprising the steps of;
applying a controlled pressure to the spark plugs by
(a) opening the throttle of the engine, and
(b) driving the engine by an external power source without applying fuel to the engine, whereby the engine speed and the throttle opening determine the maximum pressure developed in the engine,
applying ignition voltage to the spark plugs at a predetermined firing angle, whereby the firing angle selects the pressure at the spark plugs at the instant of firing,
sensing the voltage developed in the spark plugs, and
evaluating the voltage level of each spark plug and comparing it to acceptable standards to determine the presence of faults.

9. A method of testing spark plugs under load while installed in an engine comprising the steps of;
applying a controlled pressure to the spark plugs by
(a) opening the throttle of the engine, and
(b) driving the engine by an external power source without applying fuel to the engine, whereby the engine speed and the throttle opening determine the maximum pressure developed in the engine,
applying ignition voltage to the spark plugs via a distributor at a predetermined firing angle, whereby the firing angle selects the pressure at the spark plugs at the instant of firing,
sensing a tachometer signal at the distributor,
measuring the arc duration from the tachometer signal,
sensing the voltage developed in the spark plugs, and
evaluating the voltage level and arc duration of each spark plug and comparing them to acceptable standards to determine the presence of faults.

10. A method of testing spark plugs under load while installed in an engine comprising the steps of;
opening the throttle of the engine to wide open position,
applying ignition voltage to the spark plugs,
driving the engine at a fixed speed on the order of 200 RPM by an external power source,
withholding fuel from the engine,
sensing the voltage developed in the spark plugs,
comparing the voltage level of each spark plug to a preset voltage range and signalling a fault condition when a spark plug voltage level is outside the range, and
displaying the frequency of fault conditions.

11. A method of testing spark plugs under load while installed in an engine comprising the steps of;
opening the throttle of the engine to wide open position,
driving the engine at a fixed speed on the order of 200 RPM by an external power source,
withholding fuel from the engine,
applying ignition voltage to the spark plugs via a distributor, wherein the distributor produces a tachometer signal containing arc duration information,
sensing the tachometer signal and measuring the arc duration for each arc,
comparing the arc duration to a preset duration range and signalling a duration fault condition when an arc duration occurs outside the range,
sensing the peak voltage developed in the spark plugs,
comparing the peak voltage level of each spark plug to a preset voltage range and signalling a voltage fault condition when a spark plug voltage level is outside the range, and
displaying the frequency of duration and voltage fault conditions.

* * * * *